US011632980B2

(12) United States Patent
Besso

(10) Patent No.: US 11,632,980 B2
(45) Date of Patent: Apr. 25, 2023

(54) AEROSOL-GENERATING ARTICLE HAVING DETACHABLE FRESHENER SEGMENT

(71) Applicant: Philip Morris Products S.A., Neuchatel (CH)

(72) Inventor: Clement Besso, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 401 days.

(21) Appl. No.: 16/652,887

(22) PCT Filed: Oct. 18, 2018

(86) PCT No.: PCT/EP2018/078648

§ 371 (c)(1),
(2) Date: Apr. 1, 2020

(87) PCT Pub. No.: WO2019/077083

PCT Pub. Date: Apr. 25, 2019

(65) Prior Publication Data

US 2020/0229506 A1 Jul. 23, 2020

(30) Foreign Application Priority Data

Oct. 19, 2017 (EP) ..... 17197289

(51) Int. Cl.
*A24F 42/20* (2020.01)
*A24F 42/60* (2020.01)
(Continued)

(52) U.S. Cl.
CPC ..... *A24D 1/002* (2013.01); *A24D 1/22* (2020.01); *A24F 42/20* (2020.01); *A24F 42/60* (2020.01)

(58) Field of Classification Search
CPC ..... A24F 42/20; A24F 42/60
See application file for complete search history.

(56) References Cited

U.S. PATENT DOCUMENTS 4,138,477 A 2/1979 Gaffar
4,238,475 A 12/1980 Witzel et al.
(Continued)

FOREIGN PATENT DOCUMENTS

CN 103813726 A 5/2014
CN 103929988 A 7/2014
(Continued)

OTHER PUBLICATIONS

Combined Russian Office Action and Search Report dated Dec. 6, 2021 in corresponding Russian Patent Application No. 2020114029 (with English Translation), 10 pages.
(Continued)

*Primary Examiner* — Kelly M Gambetta
*Assistant Examiner* — Jennifer A Kessie
(74) *Attorney, Agent, or Firm* — Oblon, McClelland, Maier & Neustadt, L.L.P.

(57) ABSTRACT

An aerosol-generating article is provided, including a combustible heat source; an aerosol-generating substrate adjacent the heat source; a freshener segment upstream of the heat source and at least partially covering an upstream end of the heat source, the freshener segment including a segment of support material having an annular shape defining a channel extending through at least a part of the segment between upstream and downstream ends thereof, and at least one freshener delivery element contained within the channel and being detachable from the heat source to expose the heat source prior to use of the article; and a wrapper circumscribing at least the freshener segment and the heat source, including a line of weakness extending around the wrapper and overlying an upstream edge of the heat source so that the freshener segment is detachable from the heat source by breaking the wrapper along the line of weakness.

10 Claims, 1 Drawing Sheet

(51) Int. Cl.
*A24D 1/22* (2020.01)
*A24D 1/00* (2020.01)

(56) References Cited

U.S. PATENT DOCUMENTS

| | | | |
|---|---|---|---|
| 5,059,416 | A | 10/1991 | Cherukuri et al. |
| 6,426,089 | B1 | 7/2002 | Sunohara et al. |
| 2018/0110257 | A1 | 4/2018 | Besso |
| 2018/0116277 | A1 | 5/2018 | Besso |

FOREIGN PATENT DOCUMENTS

| | | | |
|---|---|---|---|
| CN | 104955488 | A | 9/2015 |
| CN | 105705048 | A | 6/2016 |
| CN | 107205468 | A | 9/2017 |
| EP | 0 793 420 | B1 | 3/2000 |
| EP | 2 775 867 | A1 | 9/2014 |
| JP | 5183104 | B2 | 4/2013 |
| JP | 2016/503307 | A | 2/2016 |
| RU | 2 587 786 | C2 | 6/2016 |
| WO | WO 2012/164077 | A1 | 12/2012 |
| WO | WO 2013/068081 | A1 | 5/2013 |
| WO | WO 2014/086998 | A1 | 6/2014 |
| WO | WO 2016/174137 | A1 | 11/2016 |
| WO | WO 2016/174141 | A1 | 11/2016 |
| WO | WO 2017/114760 | A1 | 7/2017 |

OTHER PUBLICATIONS

International Search Report and Written Opinion dated Jan. 30, 2019 in PCT/EP2018/078648 filed Oct. 18, 2018.
Notice of Reasons for Rejection dated Nov. 28, 2022 in Japanese Patent Application No. 2020-520103 filed on Oct. 18, 2018, with translation, total 10 pages.
Chinese Office Action dated Dec. 5, 2022 in Chinese Patent Application No. 201880064438.2 filed on Oct. 18, 2018, (with translation, total 15 pages).

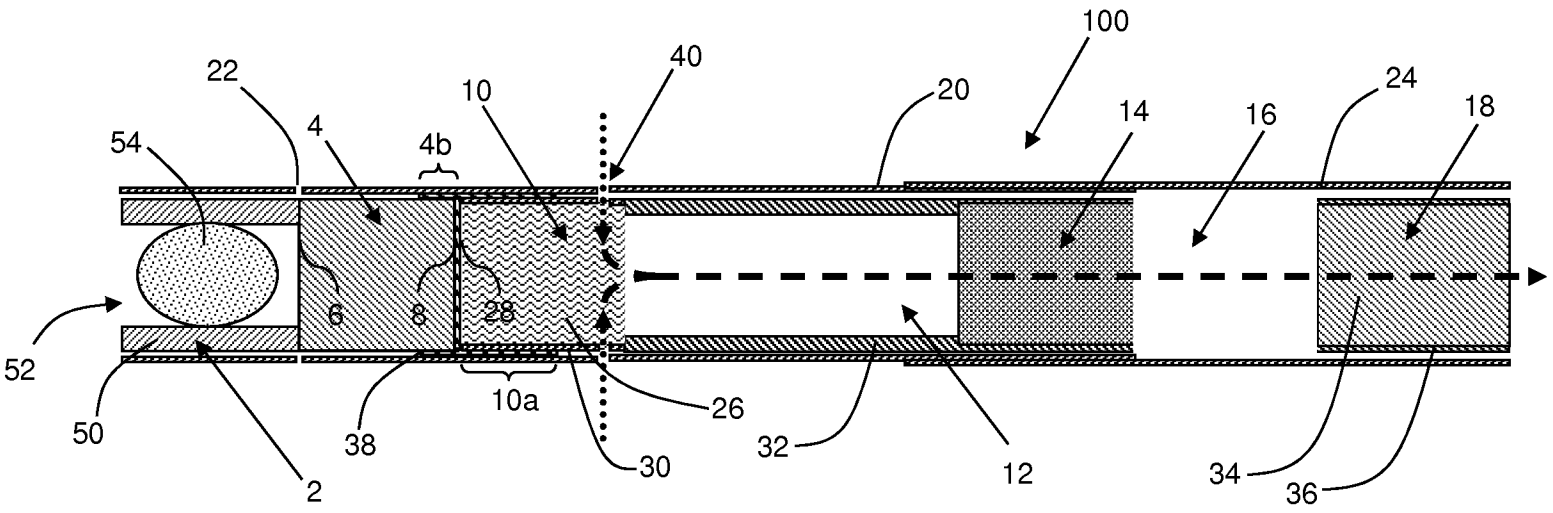
100
40
20
24
22
54
52
50
2
4
4b
10
10a
18
16
14
12
8
6
28
26
30
32
34
36
38

AEROSOL-GENERATING ARTICLE HAVING DETACHABLE FRESHENER SEGMENT

The present invention relates to an aerosol-generating article comprising a detachable freshener segment.

Aerosol-generating articles in which an aerosol-generating substrate, such as a tobacco-containing substrate, is heated rather than combusted, are known in the art. In one known type of heated aerosol-generating article, an aerosol is generated by the transfer of heat from a combustible heat source to an aerosol-generating substrate located downstream of the combustible heat source. During use of the aerosol-generating article, volatile compounds are released from the aerosol-generating substrate by heat transfer from the combustible heat source and are entrained in air drawn through the aerosol-generating article. As the released compounds cool, they condense to form an aerosol.

After consuming such an aerosol-generating article, it is common for a consumer to utilise a post-smoking breath freshener. One example of a common breath freshener is a liquid breath freshener composition that is carried in a container and sprayed into the consumer's mouth after smoking. Other known breath fresheners include chewable breath fresheners, such as mentholated sweets and chewing gum. However, some consumers may find it inconvenient to carry a separate breath freshener.

Alternative attempts at providing a freshening sensation to a consumer include the addition of menthol into the aerosol-generating article itself. However, delivering menthol via the aerosol generated during use of the aerosol-generating article often provides an inadequate delivery of menthol to the consumer when compared with breath freshener products such as sprays and chewable breath fresheners that are inserted directly into the mouth.

Therefore, it would be desirable to provide a novel breath freshener for consumers of aerosol-generating articles that mitigates or overcomes the disadvantages of known breath freshener delivery systems. It would be particularly desirable to provide such a novel breath freshener that is adapted for aerosol-generating articles incorporating a heat source.

According to the invention there is provided an aerosol-generating article comprising: a combustible heat source; an aerosol-generating substrate adjacent the combustible heat source; and a freshener segment upstream of the heat source and at least partially covering the upstream end of the combustible heat source. The freshener segment comprises a segment of support material having an annular shape defining a channel extending through at least a part of the segment of support material between an upstream end of the segment of support material and a downstream end of the segment of support material, and at least one freshener delivery element contained within the channel extending through at least a part of the segment of support material. The freshener segment is detachable from the combustible heat source to expose the heat source prior to use of the aerosol-generating article.

As used herein, the term "heated aerosol-generating article" refers to an aerosol-generating article for producing an aerosol comprising an aerosol-generating substrate that is intended to be heated rather than combusted in order to release volatile compounds that can form an aerosol.

As used herein, the term "aerosol-generating substrate" refers to a substrate capable of releasing upon heating volatile compounds, which can form an aerosol. The aerosol generated from aerosol-generating substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

As used herein, the terms "upstream" and "downstream" describe the relative positions of elements, or portions of elements, of the aerosol-generating article in relation to the direction in which a consumer draws on the aerosol-generating article during use thereof. Aerosol-generating articles as described herein comprise a downstream end (that is, the mouth end) and an opposed upstream end. In use, a consumer draws on the downstream end of the aerosol-generating article. The downstream end is downstream of the upstream end, which may also be described as the distal end.

As used herein, the term "freshener delivery element" refers to an element of the aerosol-generating article which can be used to deliver a breath freshening experience to a consumer, separate from consuming the article. That is, the freshener delivery element is not used to flavour the aerosol generated by the article during use.

By providing the freshener delivery element as an integral but detachable part of the aerosol-generating article, aerosol-generating articles in accordance with the present invention provide a convenient way for a consumer to carry the freshener delivery element. In particular, the present invention eliminates the need for a consumer to carry a separate freshener delivery element that might be used for post-smoking breath freshening, such as chewing gum.

Furthermore, providing the freshener delivery element as a detachable portion of the aerosol-generating article allows the user to remove the freshener delivery element from the aerosol-generating article prior to smoking, and subsequently administer the freshener directly into the mouth, typically after use. Therefore, aerosol-generating articles according to the present invention provide improved breath freshening when compared to known aerosol-generating articles in which a flavourant is delivered during consumption.

The provision of the freshener delivery element inside the segment of support material advantageously protects the freshener delivery element and provides a convenient way for the consumer to release the contents from the freshener delivery element into their mouth.

By providing the freshener segment upstream of the combustible heat source, the heat source is advantageously protected by the freshener segment. As such, the heat source is less prone to breakage and the aerosol-generating article may be easier to handle during manufacture, transport and use. The freshener segment may also protect the heat source from moisture as well as external contaminants, such that a more hygienic aerosol-generating article can be provided. Furthermore, the freshener segment reduces the risk of the consumer coming into direct contact with the heat source and so reduces the risk that the heat source will soil the consumer's hands or clothes.

During use, the freshener segment needs to be detached from the aerosol-generating article before the heat source of the aerosol-generating article can be ignited. The visibility of the freshener segment is therefore increased, which may lead to an improved utilisation of the freshener delivery element.

As described above, the aerosol-generating articles according to the present invention are constructed with a combustible heat source, an aerosol-generating substrate adjacent the heat source and a freshener segment at least partially covering the heat source at the upstream end. After removal of the freshener segment, the upstream end of the heat source becomes exposed at the upstream end of the aerosol-generating article.

The aerosol-generating substrate is preferably provided downstream of the heat source although in some embodiments, the aerosol-generating substrate may be provided around the heat source.

The freshener segment is provided upstream of the heat source and preferably abuts the upstream end of the heat source. Alternatively, a space may be provided between the heat source and the freshener segment. Preferably, the freshener segment fully covers the upstream end of the heat source although in some embodiments, portions of the upstream end of the heat source may be visible through holes or openings in the freshener segment.

Preferably, the aerosol-generating article further comprises a wrapper circumscribing at least the freshener segment and the heat source. The wrapper holds the freshener segment and the heat source together and may additionally combine them with other components. Preferably, the wrapper comprises a line of weakness extending around the wrapper such that the freshener segment is detachable from the heat source by breaking the wrapper along the line of weakness. For example, to detach the freshener segment a consumer may twist or bend the freshener segment relative to the remainder of the aerosol-generating article to tear the wrapper along the line of weakness.

The line of weakness is preferably a line of perforations extending around the wrapper, preferably a line of micro laser perforations. Preferably, the perforations are spaced at between 10 and 20 perforations per centimetre, more preferably about 15 perforations per centimetre. Typically, the wrapper is pre-perforated prior to being wrapped around the freshener segment and the heat source.

In some embodiments, a line of weakness in the wrapper is provided overlying the upstream end of the heat source. Upon detachment of the freshener segment, the edge of the remaining wrapper portion therefore coincides with the upstream face of the heat source. In other embodiments, a line of weakness overlies the heat source downstream of the upstream edge of the heat source such that a portion of the circumferential surface of the heat source proximate the upstream edge of the heat source is exposed upon detachment of the freshener segment. Upon detachment of the freshener segment, the edge of the remaining wrapper portion is therefore offset from the upstream face of the heat source. Such an arrangement may be beneficial to prevent burning of the wrapper upon lighting of the heat source. In certain embodiments, the line of weakness may be provided overlying the downstream end of the heat source. Upon detachment of the freshener segment, the heat source therefore becomes totally exposed.

The freshener segment of aerosol-generating articles according to the present invention comprises an annular segment of support material defining a longitudinal channel extending between the upstream and downstream ends of the segment of support material, within which is supported a freshener delivery element. The segment of support material may be formed of any suitable material. Preferably, the segment of support material is formed of a filtration material. For example, preferably, the segment of support material is an annular segment of cellulose acetate.

The channel preferably extends substantially centrally through the segment of support material between the downstream end and the upstream end. Preferably, the channel and the freshener delivery element both have a substantially circular transverse cross-sectional shape and the diameter of the freshener delivery element is larger than the diameter of the channel. With such an arrangement, the freshener delivery element can advantageously be retained in place within the channel by means of a friction fit, without the need for adhesive or other means for retaining the freshener delivery element in place.

The freshener segment preferably has at least one open end so that the freshener delivery element or the freshener within the freshener delivery element can be released from the channel into the consumer's mouth. For example, the provision of a closed upstream end may provide some protection to the freshener delivery element. Alternatively, the provision of a closed downstream end may provide separation between the freshener delivery element and the heat source to prevent contamination of the heat source by the freshener. However, in some embodiments, both ends of the freshener segment may be open.

The arrangement of the freshener delivery element within the segment of support material may be adapted such that the freshener delivery element can be removed in its entirety from the channel before releasing the contents. Alternatively, the arrangement of the freshener delivery element within the segment of support material may be adapted such that the freshener delivery element is retained within the channel during release of the contents.

The freshener segment is preferably compressible in at least a transverse direction to enable the freshener delivery element to be compressed by the consumer to release the contents of the freshener delivery element. The "transverse direction" extends perpendicular to the longitudinal axis of the aerosol-generating article.

The freshener segment preferably has an external diameter that is substantially the same as the external diameter of the heat source so that it can conveniently be combined with the heat source and the other components of the aerosol-generating article and wrapped using existing apparatus and methods.

The aerosol-generating article may optionally further comprise at least one indicia provided on an outer surface of the aerosol-generating article. The at least one indicia may comprise at least one of text and one or more graphics. The indicia may be printed or otherwise provided on the outer surface of the aerosol-generating article. The indicia may provide an indication to the consumer of the presence and position of the freshener delivery element. Alternatively or in addition, in those embodiments in which the aerosol-generating article comprises a wrapper having a line of weakness, the at least one indicia may provide an indication of the location of the line of weakness or instructions to the consumer to tear the wrapper along the line of weakness, or both. In such embodiments, the indicia is preferably provided on the wrapper and adjacent the line of weakness.

The freshener segment may optionally be circumscribed along at least a part of its length by a non-combustible element which substantially prevents the freshener segment from burning. This will ensure that the consumer does not inadvertently light the freshener segment instead of the combustible heat source as a result of failure to remove the freshener segment before use. For example, the freshener segment may be circumscribed by an aluminium sheet around at least an upstream portion of the freshener segment.

The at least one freshener delivery element within the freshener segment may take a variety of suitable forms. In some embodiments, the at least one freshener delivery element may comprise at least one solid freshener delivery element. For example, the freshener delivery element may comprise at least one of a dissolvable or chewable tablet, or chewing gum. Examples of methods and formulations for forming chewing gum are described in U.S. Pat. Nos. 4,238,475-A and 5,059,416-A. U.S. Pat. No. 4,138,477-A describes formulations for forming lozenges, pressed candy and tablets each containing a breath freshening formulation.

Additionally, or alternatively, the freshener delivery element may comprise at least one breakable capsule containing a gel or liquid freshener. Examples of breath freshening products containing a liquid or gel breath freshening composition are described in JP-5183104-B2 and EP-0793420-B1.

In any of the embodiments described above, the freshener delivery element may comprise at least one flavourant comprising at least one of menthol, linalool, thymol, eucalyptol, methyl salicylate, and combinations thereof. Additionally, or alternatively, the at least one flavourant may comprise at least one of lemon oil, peppermint oil, parsley oil, champignon essence, green tea extract, oolong tea extract, mugwort drawing-extract, apple extract, kaki-fruit extract, ginger essence, and combinations thereof. Suitable flavourants are described in U.S. Pat. No. 6,426,089-B1.

The at least one flavourant may comprise a diluent. The diluent may comprise at least one of palm oil and a medium-chain triglyceride.

Many naturally occurring flavourants can be obtained either by extraction from a natural source or by chemical synthesis if the structure of the compound is known. The flavourants can be extracted from a part of a plant or an animal by physical means, by enzymes, or by water or an organic solvent, and thus include any extractive, essence, hydrolysate, distillate, or absolute thereof. Plants that can be used to provide flavourants include, but are not limited to, those belonging to the families, Lamiaceae (for example, mints), Apiaceae (for example, anise, fennel), Lauraceae (for example, laurels, cinnamon, rosewood), Rutaceae (for example, citrus fruits), Myrtaceae (for example, anise myrtle), and Fabaceae (for example, liquorice). Non-limiting examples of sources of flavourants include mints such as peppermint and spearmint, coffee, tea, cinnamon, clove, ginger, cocoa, vanilla, chocolate, eucalyptus, geranium, agave, juniper, lemon balm, basil, cinnamon, lemon basil, chive, coriander, lavender, sage, tea, thyme and caraway. The term "mints" is used to refer to plants of the genus *Mentha*. Suitable types of mint leaf may be taken from plant varieties including but not limited to *Mentha piperita, Mentha arvensis, Mentha niliaca, Mentha citrata, Mentha spicata, Mentha spicata crispa, Mentha cordifolia, Mentha longifolia, Mentha pulegium, Mentha suaveolens*, and *Mentha suaveolens* variegate.

The freshener delivery element may provide one or more sensory effects other than a flavour sensation, such as a cooling or a warming sensation, a tingling sensation, a numbing sensation, effervescence, increased salivation, cough suppression, and combinations thereof. These sensory effects may be provided by one or more flavourants, including the flavourants listed above. Additionally, or alternatively, the freshener delivery element may comprise at least one non-flavourant material which provides one or more of these sensory effects without providing a flavour sensation. For example, suitable compounds that produce a cooling effect and can be used as an active material include, but are not limited to, the family of carboxamide compounds, such as the Wilkinson-Sword (WS) compounds WS-3 (N-Ethyl-p-menthane-3-carboxamide), WS-23 (2-Isopropyl-N,2,3-trimethylbutyramide), WS-5 [Ethyl 3-(p-menthane-3-carboxamido)acetate], WS-27 (N-Ethyl-2,2-diisopropylbutanamide), WS-14 [N-([ethoxycarbonyl]methyl)-p-menthane-3-carboxamide], and WS-116 (N-(1,1-Dimethyl-2-hydroxyethyl)-2,2-diethylbutanamide). A suitable compound that provides a cough suppression effect is benzonatate.

Preferably, the freshener delivery element has a maximum diameter of between about 2.5 mm and about 5 mm, more preferably between about 3 mm and about 4 mm. Preferably, the freshener delivery element is substantially spherical, with a diameter of between about 2.5 mm and about 5 mm.

The aerosol-generating articles of the present invention comprise a combustible heat source for heating the aerosol-generating substrate during use to generate an aerosol. Preferably, the combustible heat source of aerosol-generating articles according to the present invention is a solid combustible heat source. More preferably, the combustible heat source is a monolithic solid combustible heat source. That is, a one-piece solid combustible heat source.

Advantageously, the combustible heat source is substantially cylindrical.

The combustible heat source may have a length of between about 7 millimetres and about 17 millimetres, for example a length of between about 7 millimetres and about 15 millimetres or a length of between about 7 millimetres and about 13 millimetres.

The combustible heat source may have a diameter of between about 5 millimetres and about 9 millimetres, for example a diameter of between about 7 millimetres and about 8 millimetres.

Advantageously, the combustible heat source is a combustible carbonaceous heat source. As used herein with reference to the invention, the term 'carbonaceous' describes a combustible heat source comprising carbon.

Advantageously, the combustible heat source comprises carbonised material.

Advantageously, the combustible carbonaceous heat source has a carbon content of at least about 35 percent by dry weight of the combustible carbonaceous heat source.

The combustible carbonaceous heat source may have a carbon content of at least about 40 percent by dry weight of the combustible carbonaceous heat source or a carbon content of at least about 45 percent by dry weight of the combustible carbonaceous heat source.

The combustible carbonaceous heat source may be a combustible carbon-based heat source. As used herein with reference to the invention, the term 'carbon-based' describes a combustible carbonaceous heat source comprised primarily of carbon, that is a combustible carbonaceous heat source having a carbon content of at least about 50 percent by dry weight of the combustible carbonaceous heat source. For example, the combustible carbonaceous heat source may have a carbon content of at least about 60 percent by dry weight of the combustible carbonaceous heat source or at least about 70 percent by dry weight of the combustible carbonaceous heat source or at least about 80 percent by dry weight of the combustible carbonaceous heat source.

The combustible carbonaceous heat source may be formed from one or more suitable carbon-containing materials.

One or more binders may be combined with the one or more carbon-containing materials. In such embodiments, the combustible carbonaceous heat source may comprise one or more organic binders, one or more inorganic binders or a combination of one or more organic binders and one or more inorganic binders.

The combustible carbonaceous heat source may comprise one or more additives in order to improve the properties of the combustible carbonaceous heat source. Suitable additives include, but are not limited to: additives to promote consolidation of the combustible carbonaceous heat source (for example, sintering aids); additives to promote ignition of the combustible carbonaceous heat source (for example, oxidisers such as perchlorates, chlorates, nitrates, peroxides, permanganates, zirconium and combinations thereof); additives to promote combustion of the combustible carbonaceous heat source (for example, potassium and potassium salts, such as potassium citrate); additives to promote decomposition of one or more gases produced by combustion of the combustible carbonaceous heat source (for example catalysts, such as CuO, $Fe_2O_3$ and $Al_2O_3$); or any combination thereof.

Advantageously, the combustible carbonaceous heat source comprises at least one ignition aid. In certain preferred embodiments, the combustible carbonaceous heat source comprises at least one ignition aid as described in WO 2012/164077 A1.

Suitable processes for producing combustible carbonaceous heat sources for use in aerosol-generating articles according to the invention are known in the art and include, but are not limited to, pressing processes and an extrusion processes.

In certain preferred embodiments, the combustible heat source is a pressed combustible carbonaceous heat source.

Aerosol-generating articles according to the present invention also comprise an aerosol-generating substrate adjacent the heat source.

Advantageously, the aerosol-generating substrate comprises aerosol-forming material comprising an aerosol-former.

The aerosol former may be any suitable compound or mixture of compounds that, in use, facilitates formation of a dense and stable aerosol and that is substantially resistant to thermal degradation at the operating temperature of the aerosol-generating article. Suitable aerosol formers are known in the art and include, but are not limited to: polyhydric alcohols, such as triethylene glycol, propylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Advantageously, the aerosol former comprises one or more polyhydric alcohols.

More advantageously, the aerosol former comprises glycerine.

Preferably, the aerosol-generating substrate is a solid aerosol-generating substrate. The aerosol-generating substrate may comprise both solid and liquid components.

The aerosol-generating substrate may comprise plant-based material. The aerosol-generating substrate may comprise homogenised plant-based material.

The aerosol-generating substrate may comprise nicotine.

The aerosol-generating substrate may comprise tobacco material.

As used herein with reference to the invention, the term 'tobacco material' describes any material comprising tobacco, including, but not limited to, tobacco leaf, tobacco rib, tobacco stem, tobacco stalk, tobacco dust, expanded tobacco, reconstituted tobacco material and homogenised tobacco material.

The tobacco material may, for example, be in the form of powder, granules, pellets, shreds, strands, strips, sheets or any combination thereof.

Advantageously, the aerosol-generating substrate comprises homogenised tobacco material.

As used herein with reference to the invention, the term 'homogenised tobacco material' describes a material formed by agglomerating particulate tobacco.

Advantageously, the aerosol-generating substrate comprises a gathered sheet of homogenised tobacco material.

In certain embodiments, the aerosol-generating substrate comprises a rod comprising a gathered sheet of homogenised tobacco material.

The aerosol-generating substrate may comprise aerosol-forming material and a wrapper around and in contact with the aerosol-forming material.

The wrapper may be formed from any suitable sheet material that is capable of being wrapped around aerosol-forming material to form an aerosol-generating substrate.

In certain preferred embodiments, the aerosol-generating substrate comprises a rod comprising a gathered sheet of homogenised tobacco material and a wrapper around and in contact with the tobacco material.

As used herein with reference to the invention, the term 'rod' denotes a generally cylindrical element of substantially circular, oval or elliptical cross-section.

As used herein with reference to the invention, the term 'sheet' describes a laminar element having a width and length substantially greater than the thickness thereof.

As used herein with reference to the invention, the term 'gathered' describes a sheet that is convoluted, folded, or otherwise compressed or constricted substantially transversely to the longitudinal axis of the aerosol-generating article.

Advantageously, the aerosol-generating substrate comprises a gathered textured sheet of homogenised tobacco material.

As used herein with reference to the invention, the term 'textured sheet' describes a sheet that has been crimped, embossed, debossed, perforated or otherwise deformed.

Use of a textured sheet of homogenised tobacco material may advantageously facilitate gathering of the sheet of homogenised tobacco material to form the aerosol-generating substrate.

The aerosol-generating substrate may comprise a gathered textured sheet of homogenised tobacco material comprising a plurality of spaced-apart indentations, protrusions, perforations or any combination thereof.

In certain preferred embodiments, the aerosol-generating substrate comprises a gathered crimped sheet of homogenised tobacco material.

As used herein with reference to the invention, the term 'crimped sheet' describes a sheet having a plurality of substantially parallel ridges or corrugations.

Advantageously, when the aerosol-generating article has been assembled, the substantially parallel ridges or corrugations extend along or parallel to the longitudinal axis of the aerosol-generating article. This facilitates gathering of the crimped sheet of homogenised tobacco material to form the aerosol-generating substrate.

However, it will be appreciated that crimped sheets of homogenised tobacco material for inclusion in the aerosol-generating substrates of aerosol-generating articles according to the invention may alternatively or in addition have a plurality of substantially parallel ridges or corrugations that are disposed at an acute or obtuse angle to the longitudinal axis of the aerosol-generating article when the aerosol-generating article has been assembled.

As an alternative to the use of a gathered sheet of homogenised tobacco material, as described above, the aerosol-generating substrate may be formed of a plurality of strips or shreds of a sheet of homogenised tobacco material.

For example, the aerosol-generating substrate may be formed of a plurality of shreds of homogenised tobacco material that are aligned in the longitudinal direction and have been brought together and wrapped to form a rod of aerosol-generating substrate.

Preferably, the aerosol-generating substrate is substantially cylindrical.

The aerosol-generating substrate may have a length of between about 5 millimetres and about 20 millimetres, for example a length of between about 6 millimetres and about 15 millimetres or a length of between about 7 millimetres and about 12 millimetres.

The aerosol-generating substrate may have a diameter of between about 5 millimetres and about 9 millimetres, for example a diameter of between about 7 millimetres and about 8 millimetres.

Aerosol-generating articles according to the invention may further comprise one or more of: a heat conducting element which circumscribes at least a portion of the combustible heat source and at least a portion of the aerosol-generating substrate; a transfer element downstream of the aerosol-generating substrate; and an aerosol-cooling element or heat exchanger downstream of the aerosol-generating substrate.

Aerosol-generating articles according to the invention may further comprise a mouthpiece downstream of the aerosol-generating substrate. That is, a mouthpiece located between the aerosol-generating substrate and the downstream end of the aerosol-generating article.

Preferably, the mouthpiece is located at the downstream end of the aerosol-generating article.

Preferably, the mouthpiece is of low filtration efficiency, more preferably of very low filtration efficiency.

The mouthpiece may be a single segment or component mouthpiece.

Alternatively, the mouthpiece may be a multi-segment or multi-component mouthpiece.

The mouthpiece may comprise a filter comprising one or more segments comprising suitable filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

Aerosol-generating articles according to the invention may comprise one or more aerosol modifying agents downstream of the aerosol-generating substrate. For example, where included, one or more of the mouthpiece, transfer element and aerosol-cooling element of aerosol-generating articles according to the invention may comprise one or more aerosol modifying agents.

As used herein with reference to the invention, the term 'aerosol-modifying agent' describes any agent that, in use, modifies one or more features or properties of an aerosol generated by the aerosol-generating substrate of the aerosol-generating article.

Suitable aerosol-modifying agents include, but are not limited to: flavourants; and chemesthetic agents.

As used herein with reference to the invention, the term 'chemesthetic agent' describes any agent that, in use, is perceived in the oral or olfactory cavities of a user by means other than, or in addition to, perception via taste receptor or olfactory receptor cells. Perception of chemesthetic agents is typically via a "trigeminal response," either via the trigeminal nerve, glossopharyngeal nerve, the vagus nerve, or some combination of these. Typically, chemesthetic agents are perceived as hot, spicy, cooling, or soothing sensations.

Aerosol-generating articles according to the invention may comprise one or more aerosol modifying agents that are both a flavourant and a chemesthetic agent downstream of the aerosol-generating substrate. For example, where included, one or more of the mouthpiece, transfer element and aerosol-cooling element of aerosol-generating articles according to the invention may comprise menthol or another flavourant that provides a cooling chemesthetic effect.

Aerosol-generating articles according to the invention preferably comprise one or more wrappers circumscribing the components of the aerosol-generating article. Each wrapper may circumscribe a single component or a plurality of components. Preferably, the outer wrapper is provided around all of the components upstream of the mouthpiece. Preferably, the mouthpiece is attached to the remainder of the components by means of a tipping wrapper.

Aerosol-generating articles according to the invention may be assembled using known methods and machinery.

The invention will be further described, by way of example only, with reference to the accompanying drawing in which:

FIG. 1 shows a schematic longitudinal cross-sectional view of an aerosol-generating article according to the present invention.

The aerosol-generating article 100 according to the embodiment of the invention shown in FIG. 1 comprises a freshener segment 2, a combustible carbonaceous heat source 4 having an upstream end face 6 and an opposed downstream end face 8, an aerosol-generating substrate 10, a transfer element 12, an aerosol-cooling element 14, a space 16 and a mouthpiece 18 in abutting coaxial alignment. The freshener segment 2, the heat source 4, the aerosol-generating substrate 10, transfer element 12 and aerosol-cooling element 14 are wrapped in an outermost wrapper 20. As shown in FIG. 1, a line of perforations 22 is provided in the outermost wrapper 20 to enable the freshener segment to be detached from the remainder of the aerosol-generating article 100. The line of perforations 22 circumscribes the aerosol-generating article 100 and overlies the upstream end face 6 of the heat source 4. The line of weakness 22 comprises a line of micro laser perforations.

As shown in FIG. 1, a downstream end portion of the outermost wrapper 20 around a downstream portion of the aerosol-cooling element 14, the space 16 and the mouthpiece 18 are wrapped in a band of tipping paper 24, which connects the mouthpiece 18 to the other components of the aerosol-generating article 100.

The freshener segment 2 comprises an annular segment 50 formed of a hollow cellulose acetate tube which defines a central channel 52 extending through the annular segment 50 between its upstream and downstream ends. Contained within the channel 52 is a freshener delivery element 54 comprising a breakable capsule containing a liquid menthol flavourant.

The combustible carbonaceous heat source 4 is a blind carbonaceous combustible heat source and is located downstream of the freshener segment 2. After the removal of the freshener segment 2, the heat source 4 is located at the upstream end of the aerosol-generating article 100. As shown in FIG. 1, a non-combustible substantially air impermeable barrier 28 in the form of a disc of aluminium foil is provided between the downstream end face 8 of the combustible carbonaceous heat source 4 and the aerosol-generating substrate 10. The barrier 28 is applied to the downstream end face 8 of the combustible carbonaceous heat source 4 by pressing the disc of aluminium foil onto the downstream end face 8 of the combustible carbonaceous heat source 4 and abuts the downstream end face 8 of the combustible carbonaceous heat source 4 and the a upstream end of the aerosol-generating substrate 10.

The aerosol-generating substrate 10 is located immediately downstream of the barrier 28 applied to the downstream end face 8 of the combustible carbonaceous heat source 4. The aerosol-generating substrate 10 comprises a gathered crimped sheet of homogenised tobacco material 26 and a wrapper 30 around and in contact with the gathered crimped sheet of homogenised tobacco material 26. The gathered crimped sheet of homogenised tobacco material 26 comprises a suitable aerosol former such as, for example, glycerine.

The transfer element 12 is located immediately downstream of the aerosol-generating substrate 10 and comprises a cylindrical open-ended hollow cellulose acetate tube 32.

The aerosol-cooling element 14 is located immediately downstream of the transfer element 12 and comprises a gathered sheet of biodegradable polymeric material such as, for example, polylactic acid.

The mouthpiece 18 is located downstream of the aerosol-cooling element 14. As shown in FIG. 1, the mouthpiece 18 is located at the downstream end of the aerosol-generating article 100 and comprises a cylindrical plug of suitable filtration material 34 such as, for example, cellulose acetate tow of very low filtration efficiency, wrapped in filter plug wrap 36.

In the aerosol-generating article 100 according to the embodiment of the invention shown in FIG. 1, the aerosol-generating article 100 comprises a space 16 between the aerosol-cooling element 14 and the mouthpiece 18.

In other embodiments of the invention (not shown) the space 16 between the aerosol-cooling element 14 and the mouthpiece 18 may be omitted and the mouthpiece 18 may be located immediately downstream of the aerosol-cooling element 14.

In further embodiments of the invention (also not shown) both the aerosol-cooling element and the space 16 between the aerosol-cooling element 14 and the mouthpiece 18 may both be omitted and the mouthpiece 18 may be located immediately downstream of the transfer element 12.

As shown in FIG. 1, the aerosol-generating article 100 further comprises a heat-conducting element 38 formed from a suitable thermally conductive material such as, for example, aluminium foil around and in direct contact with a downstream portion 4*b* of the combustible carbonaceous heat source 4 and an upstream portion 10*a* of the aerosol-generating substrate 10. In the aerosol-generating article 100 according to the embodiment of the invention shown in FIG. 1, the aerosol-generating substrate 10 extends downstream beyond the heat-conducting element 38.

The aerosol-generating article 100 according to the embodiment of the invention shown in FIG. 1 comprises one or more air inlets 40 around the periphery of a downstream portion of the aerosol-generating substrate 10. As shown in FIG. 1, a circumferential arrangement of air inlets 40 is provided in the wrapper 30 of the aerosol-generating substrate 10 and the overlying outermost wrapper 20 to admit cool air (shown by dotted arrows in FIG. 1) into the aerosol-generating substrate 10.

In use, the user detaches the freshener segment 2 from the remainder of the aerosol-generating article 100 by twisting or bending the freshener segment 2 to break the outermost wrapper 20 along the line of perforations 22. The freshener segment 2 may be retained such that the consumer can break the freshener delivery element 54 to release the menthol flavourant into their mouth before, during or after use of the aerosol-generating article 100.

After the freshener segment 2 has been detached, the user may ignite the combustible carbonaceous heat source 4. Once the combustible carbonaceous heat source 4 is ignited the user draws on the mouthpiece 18 of the aerosol-generating article 100. When a user draws on the mouthpiece 18, cool air (shown by dotted arrows in FIG. 1) is drawn into the aerosol-generating substrate 10 of the aerosol-generating article 100 through the air inlets 40.

The periphery of the upstream portion 10*a* of the aerosol-generating substrate 10 is heated by conduction through the downstream end face 8 of the combustible carbonaceous heat source 4 and the barrier 28 and through the heat-conducting element 38.

The heating of the aerosol-generating substrate 10 by conduction releases aerosol former and other volatile and semi-volatile compounds from the gathered crimped sheet of homogenised tobacco material 26. The compounds released from the aerosol-generating substrate 10 form an aerosol that is entrained in the air drawn into the aerosol-generating substrate 10 of the aerosol-generating article 100 through the air inlets 40 as it flows through the aerosol-generating substrate 10. The drawn air and entrained aerosol (shown by dashed arrows in FIG. 1) pass downstream through the interior of the cylindrical open-ended hollow cellulose acetate tube 32 of the transfer element 12 and the aerosol-cooling element 14, where they cool and condense. The cooled drawn air and entrained aerosol pass downstream through the space 16 and the mouthpiece 18 and are delivered to the user through the downstream end of the aerosol-generating article 100.

The non-combustible substantially air impermeable barrier 28 on the downstream end face 8 of the combustible carbonaceous heat source 4 isolates the combustible carbonaceous heat source 4 from air drawn through the aerosol-generating article 100 such that, in use, air drawn through the aerosol-generating article 100 does not come into direct contact with the combustible carbonaceous heat source 4.

The invention claimed is:

1. An aerosol-generating article, comprising:

a combustible heat source;

an aerosol-generating substrate adjacent the combustible heat source;

a freshener segment upstream of the combustible heat source and at least partially covering an upstream end of the combustible heat source, the freshener segment comprising a segment of support material having an annular shape defining a channel extending through at least a part of the segment of support material between an upstream end of the segment of support material and a downstream end of the segment of support material, and at least one freshener delivery element contained within the channel, wherein the at least one freshener segment is detachable from the combustible heat source to expose the combustible heat source prior to use of the aerosol-generating article; and a wrapper circumscribing at least the at least one freshener segment and the combustible heat source, the wrapper comprising a line of weakness extending around the wrapper so that the at least one freshener segment is detachable from the combustible heat source by breaking the wrapper along the line of weakness, wherein the line of weakness overlies an upstream edge of the combustible heat source.

2. The aerosol-generating article according to claim 1, wherein each of the channel and the at least one freshener delivery element has a substantially circular transverse cross sectional shape, and wherein an internal diameter of the channel is less than an external diameter of the at least one freshener delivery element.

3. The aerosol-generating article according to claim 1, wherein the at least one freshener delivery element comprises at least one solid freshener delivery element.

4. The aerosol-generating article according to claim 1, wherein the at least one freshener delivery element comprises at least one breakable capsule containing a gel or a liquid freshener.

5. The aerosol-generating article according to claim 1, wherein the at least one freshener delivery element comprises at least one of menthol, linalool, thymol, eucalyptol, methyl salicylate, and combinations thereof.

6. The aerosol-generating article according to claim 1, wherein the channel is open only at one end thereof.

7. The aerosol-generating article according to claim 1, wherein the freshener segment is compressible along at least a transverse axis of the aerosol-generating article.

8. The aerosol-generating article according to claim 1, wherein the freshener segment has substantially a same diameter as the combustible heat source.

9. The aerosol-generating article according to claim 1, wherein the freshener segment comprises visible indicia on an outer surface thereof.

10. The aerosol-generating article according to claim 1, wherein the freshener segment is circumscribed along at least a part of a length thereof by a non-combustible element.

* * * * *